US011786016B2

(12) United States Patent
Arai et al.

(10) Patent No.: US 11,786,016 B2
(45) Date of Patent: Oct. 17, 2023

(54) FASTENER CHAIN AND SLIDE FASTENER

(71) Applicant: YKK Corporation, Tokyo (JP)

(72) Inventors: Takumi Arai, Kurobe (JP); Kenichi Yamada, Kurobe (JP)

(73) Assignee: YKK Corporation, Tokyo (JP)

( * ) Notice: Subject to any disclaimer, the term of this patent is extended or adjusted under 35 U.S.C. 154(b) by 141 days.

(21) Appl. No.: 17/605,152

(22) PCT Filed: May 9, 2019

(86) PCT No.: PCT/JP2019/018602
§ 371 (c)(1),
(2) Date: Oct. 20, 2021

(87) PCT Pub. No.: WO2020/225915
PCT Pub. Date: Nov. 12, 2020

(65) Prior Publication Data

US 2022/0192325 A1 Jun. 23, 2022

(51) Int. Cl.
*A44B 19/40* (2006.01)
*A44B 19/12* (2006.01)
*A44B 19/34* (2006.01)

(52) U.S. Cl.
CPC ..... *A44B 19/12* (2013.01); *A44B 19/34* (2013.01)

(58) Field of Classification Search
CPC ..... A44B 19/34; A44B 19/12
See application file for complete search history.

(56) References Cited

U.S. PATENT DOCUMENTS 3,149,388 A * 9/1964 Wilcken ..... A44B 19/406 24/396
3,490,110 A * 1/1970 Alfons ..... A44B 19/42 112/475.16

(Continued)

FOREIGN PATENT DOCUMENTS

CN 1282556 A 2/2001
CN 1301513 A 7/2001

(Continued)

OTHER PUBLICATIONS

Office Action, Chinese Patent Application No. 201980096174.3, dated Apr. 28, 2022, 26 pages.

(Continued)

*Primary Examiner* — Jason W San
(74) *Attorney, Agent, or Firm* — Kilpatrick Townsend & Stockton LLP

(57) ABSTRACT

A coil-shaped fastener element is sewn to a fastener tape without using a core string. An upper leg portion of the fastener element has a first upper surface continued from a connecting portion and contacting a sewing thread, and a second upper surface extending and sloping upward from the first upper surface via a bent portion. A height dimension between a top end surface and the bent portion of the upper leg portion is 20% or larger of a height dimension of the fastener element. The upper leg portion has a first lower surface which is sloped to be apart from the fastener tape toward a coupling head portion, and the upper leg portion has an element contacting portion in an area of the first lower surface. Thereby, cost reduction of the slide fastener can be attained, and the fastener element can be prevented from passing through the sewing thread and exiting.

6 Claims, 4 Drawing Sheets

(56) References Cited

U.S. PATENT DOCUMENTS

| | | | | | |
|---|---|---|---|---|---|
| 3,605,206 | A | | 9/1971 | Fröhlich | |
| 3,789,465 | A | * | 2/1974 | Moertel | A44B 19/12 24/395 |
| 3,855,671 | A | * | 12/1974 | Fujisaki | A44B 19/406 24/394 |
| 5,129,127 | A | * | 7/1992 | Hamatani | A44B 19/34 24/393 |
| 5,142,747 | A | * | 9/1992 | Matsushima | A44B 19/12 24/392 |
| 6,497,015 | B1 | * | 12/2002 | Kato | A44B 19/12 24/402 |
| 2001/0004787 | A1 | | 6/2001 | Nagata et al. | |
| 2006/0200950 | A1 | * | 9/2006 | Kousaka | A44B 19/12 24/396 |
| 2013/0133161 | A1 | | 5/2013 | Ren | |
| 2014/0230197 | A1 | * | 8/2014 | Miyazaki | A44B 19/403 112/475.16 |
| 2018/0110302 | A1 | * | 4/2018 | Chou | B29C 66/81423 |

FOREIGN PATENT DOCUMENTS

| | | | |
|---|---|---|---|
| CN | 2631270 | Y | 8/2004 |
| CN | 103153122 | A | 6/2013 |
| CN | 104379016 | A | 2/2015 |
| CN | 104585979 | A | 5/2015 |
| CN | 106572727 | A | 4/2017 |
| DE | 112012005338 | B4 | 1/2019 |
| EP | 1072209 | A2 | 1/2001 |
| EP | 1112700 | A2 | 7/2001 |
| EP | 1072209 | A3 | 10/2001 |
| EP | 1112700 | A3 | 2/2004 |
| JP | S49-039136 | B1 | 10/1974 |
| JP | S49-041653 | B1 | 11/1974 |
| JP | H04-064302 | A | 2/1992 |
| JP | 2001-037507 | A | 2/2001 |
| TW | 201315407 | A | 4/2013 |
| WO | 2013/094335 | A1 | 6/2013 |
| WO | 2014/002218 | A1 | 1/2014 |
| WO | 2016/016952 | A1 | 2/2016 |

OTHER PUBLICATIONS

Decision of Refusal, Taiwanese Patent Application No. 109107421, dated Nov. 4, 2021, 10 pages.

International Search Report, PCT Patent Application No. PCT/JP2019/018602, dated Jul. 9, 2019.

Office Action, Taiwanese Patent Application No. 109107421, dated Dec. 18, 2020.

European Extended Search Report, European Patent Application No. 19927829.2, dated Mar. 31, 2022, 6 pages.

Office Action, Taiwanese Patent Application No. 109107421, dated Apr. 17, 2023, 12 pages.

* cited by examiner

FASTENER CHAIN AND SLIDE FASTENER

TECHNICAL FIELD

The present invention relates to a fastener chain having a right and left pair of fastener stringers in which a plurality of fastener elements continuing in a coil shape are sewn to a fastener tape, and a slide fastener formed using the fastener chain.

BACKGROUND ART

As one type of the slide fasteners, a slide fastener in which a plurality of fastener elements obtained by molding a synthetic resin monofilament in a coil shape are attached to a fastener tape is known. Generally, the plurality of fastener elements continuing in a coil shape are fixed to the fastener tape with a sewing thread along with a core string in a state that the core string passes through between an upper leg portion and a lower leg portion of each fastener element, thereby an element row is formed along a tape length direction of the fastener tape.

An example of the slide fastener in which a plurality of coiled fastener elements are sewn to the fastener tape is described in JP2001-37507A (Patent Document 1). In the slide fastener of Patent Document 1, as shown in FIG. 7, a plurality of the coiled fastener elements 71 are sewn to the fastener tape 74 together with the core string 72 by multi-thread chain stitching of the sewing thread 73 to form the fastener stringer 70.

The fastener element 71 has a coupling head portion 71a, an upper leg portion 71b and a lower leg portion 71c extending from the coupling head portion 71a in a tape width direction and a connecting portion 71d connecting the upper leg portion 71b (or the lower leg portion 71c) to a lower leg portion 71c (or an upper leg portion 71b) of another fastener element 71 adjacent in a tape length direction. The upper leg portion 71b and the lower leg portion 71c are disposed to be apart from each other in a tape top and back direction.

The core string 72 passes between the upper leg portion 71b and the lower leg portion 71c of the fastener element 71 throughout the element row. In this case, the sewing thread 73 used for fixing the fastener element 71 has a needle thread and a looper thread which form a sewn portion by interlooping. The needle thread of the sewing thread 73 pierces the fastener tape 74 and the core string 72, and the looper thread presses an upper surface of the upper leg portion 71b, thereby each fastener element 71 is fixed to the fastener tape 74 with the sewn portion together with the core string 72.

Since each fastener element 71 is sewn together with the core string 72, the fastener element 71 is firmly fixed to a predetermined position of the fastener tape 74. Further, since the fixing state of the fastener element 71 is stabilized, the fastener element 71 can be prevented from, for example, dropping from between the needle thread and the looper thread of the sewing thread 73.

In the upper leg portion 71b of the fastener element 71 of Patent Document 1, a step portion 75 is provided, and due to the step portion 75, the upper surface of the upper leg portion 71b disposed on the connecting portion 71d side of the step portion 75 is disposed at a lower position regarding the height direction than the upper surface of the upper leg portion 71b disposed on the coupling head portion 71a side of the step portion 75. Since the sewing thread 73 (looper thread) is arranged at the low upper surface of the upper leg portion 71b on the connecting portion 71d side, the sewing thread 73 can be less likely to be contacted with the slider when the slider is slid along the element row, and as a result, the abrasion of the sewing thread 73 is suppressed.

In the case of the fastener element 71 of Patent Document 1, the core string 72 is interposed by the upper leg portion 71b and the lower leg portion 71c, as shown in FIG. 7. Therefore, regarding the tape top and back direction, a range that the upper surface of the upper leg portion 71b on the connecting portion 71d side can be lowered with respect to the upper surface on the coupling head portion 71a side is restricted due to the presence of the core string 72.

Therefore, a dimension in the height direction from the upper surface position on the coupling head portion 71a side to the upper surface position on the connecting portion 71d side in the upper leg portion 71b (a difference in the height direction between the two upper surface positions) has been conventionally about 10% or so of the height dimension of the whole fastener element 71, at the largest. Therefore, because when the step portion 75 is provided, it is sufficient that the sewing thread 73 is arranged lower than the upper surface position of the upper leg portion 71b on the coupling head portion 71a side, it has not been needed to secure a so large difference between the two upper surface positions in the height direction as above.

Further in the fastener element 71 as in Patent Document 1, the sewing thread 73 for fixing the fastener element 71 pierces the core string 72 and pushes the upper surface of the upper leg portion 71b toward the fastener tape 74. In order to arrange the sewing thread 73 for piercing the core string 72 on the upper surface on the connecting portion 71d side of the upper leg portion 71b which has a low height position, it has been needed to secure the upper surface on the connecting portion 71b side to be large in some extent in the tape width direction so as to correspond to a width dimension of the core string 72.

Therefore, in a front view of the fastener element 71 viewed from the tape length direction, the step portion 75 of the upper leg portion 71b was provided so that a width dimension (dimension in the tape width direction) from a position of an element end edge of the fastener element 71 on the connecting portion 71d side to a boundary position between the upper surface of the upper leg portion 71b on the connecting portion 71d side and a sloped surface of the step portion 75 can secure a size at least 50% with respect to the width dimension of the entire fastener element 71.

PRIOR ART DOCUMENT

Patent Documents

Patent Document 1: 2001-37507 A

SUMMARY OF INVENTION

Problems to be Solved by the Invention

In the slide fastener having a coil-shaped fastener element, it has been studied to sew the coil-shaped fastener element directly to a fastener tape without using a core string in order to reduce manufacturing cost.

However, when the coil-shaped fastener element is fixed to the fastener tape without using the core string, it is fixed so that each fastener element is held between a needle thread of the sewing thread which pierces the fastener tape and a looper thread. Therefore, in a case that a fastener stringer is twisted, for example, when the fastener element is pressed toward a tape inside of the fastener tape, it was possible that the fastener element exited from between the needle thread and the looper thread, and came off from the fastener tape.

Also in a case that the slide fastener is formed such that the core string continuously passes through the coil-shaped fastener element along an element row, when right and left element rows are coupled, right and left core strings can be contacted by each coupling head portion of the fastener element of the coupling counterpart. Thereby, it becomes possible that a dimension in the tape width direction that the coupled right and left fastener elements are coupled to overlap (coupled amount or coupled depth) can be regulated by the right and left core strings.

On the other hand, when the core string is not used, the coupling amount of the right and left element rows as above cannot be regulated. Therefore, when the right and left plural fastener elements are coupled with each other, it becomes possible that between the fastener elements adjacent in the length direction in each of the right and left fastener elements, a counterpart fastener element deeply enters near the connecting portion in the tape width direction.

However, in a case that the right and left fastener elements enter into a deep position in the tape width direction each other, when the sewing processing to sew the right and left plural fastener elements in a coupled state with each other to the right and left fastener tapes is performed using a sewing machine, for example, the counterpart fastener element which is deeply entered bothers and prevents a sewing needle from being smoothly inserted between the fastener elements adjacent in the length direction.

The present invention is made in view of the above conventional problems, and its objective is to provide a fastener chain in which a coil-shaped fastener element is sewn to a fastener tape without using a core string, which can prevent the fastener element from exiting from between the sewing thread, and which can stably secure a space for inserting a sewing needle between the fastener elements adjacent in the length direction at the time of sewing processing with a sewing machine, and to provide a slide fastener formed using the fastener chain.

Means for Solving the Problems

In order to achieve the above object, a fastener chain provided by the present invention is, as the main feature, the fastener chain having a pair of fastener stringers in which a plurality of fastener elements continuing in a coil shape are respectively sewn with a sewing thread to right and left fastener tapes, in which the fastener element has a coupling head portion, a lower leg portion extending from one end part of the coupling head portion and contacted with the fastener tape, an upper leg portion extending in a tape width direction from the other end part of the coupling head portion to be apart from the lower leg portion, and a connecting portion connecting the upper leg portion and a lower leg portion of another fastener element adjacent in a length direction; in which the fastener element is sewn to the fastener tape such that the upper leg portion and the lower leg portion face to each other via a space portion, the upper leg portion has a first upper surface continuing from the connecting portion and a second upper surface extending and sloping upward from the first upper surface via a bent portion toward the coupling head portion, the sewing thread pierces the fastener tape and is arranged to contact with the first upper surface of the upper leg portion, a height dimension between a position of a top end surface of the upper leg portion disposed apart farthest from the fastener tape and a position of the bent portion is 20% or larger of the height dimension of the whole fastener element, the upper leg portion has a first lower surface sloped toward the coupling head portion so as to be apart from the fastener tape, and a second lower surface sloped toward the coupling head portion so as to approach the fastener tape or be parallel with the fastener tape, and the upper leg portion has an element contacting portion to contact the fastener element of the coupling counterpart.

In the fastener chain of the present invention, it is preferable that the space portion has, regarding the tape width direction, a first space portion disposed on the coupling head portion side of the bent portion and a second space portion disposed on the coupling head portion side of the bent portion and provided with a larger height dimension than the first space portion, and the element contacting portion is disposed to bulge in a convex surface shape toward the second space portion in a front view of the fastener element.

In the fastener chain of the present invention, it is preferable that a height dimension between a position of the top end surface and a position of the bent portion in the upper leg portion is 25% or smaller of the height dimension of the whole fastener element.

It is also preferable that a monofilament forming a plurality of the fastener elements has a cross-sectional shape at the upper leg portion and the lower leg portion showing a flattened substantially oval shape that a larger width dimension of the monofilament than the height dimension of the monofilament.

Further, it is preferable that a maximum value of the height dimension of the second space portion is 50% or larger and 100% or smaller of the height dimension of the lower leg portion.

Next, a slide fastener provided by the present invention is, as the main feature, formed by attaching a slider to right and left element rows of the fastener chain having the above-mentioned structure.

Effects of the Invention

In the fastener chain according to the present invention, a plurality of fastener elements continuing in a coil shape are sewn to a fastener tape with a sewing thread. In this case, the fastener element is sewn to the fastener tape in a state that the upper leg portion and the lower leg portion of the fastener element directly face to each other via the space portion without a conventional core string being interposed.

The upper leg portion of the fastener element has a first upper surface continuing from the connecting portion, and a second upper surface extending from the first upper surface via a bent portion toward the coupling head portion and sloped upward to be apart from the fastener tape. In this case, slope angles of the first upper surface and the second upper surface with respect to the tape upper surface of the fastener tape are changed at the bent portion. The sewing thread pierces the fastener tape only, and arranged to contact the first upper surface of the upper leg portion, thereby, fixes the fastener element to the fastener tape.

In the present invention, the height dimension (dimension in the height direction) between the position of the top end surface and the position of the bent portion disposed on the upper leg portion is 20% or larger of the height dimension of the whole fastener element. The top end surface of the upper leg portion here is an upper surface of the upper leg portion disposed to be farthest in a tape top and back direction (height direction) from the tape upper surface of the fastener tape in a front view (or a back view) when the fastener element is viewed from the tape length direction, and may be formed in a flat plate shape or a curved surface shape.

Since the height dimension between the top end surface and the bent portion of the upper leg portion is a size of 20% or larger of the height dimension of the whole fastener element, a difference (step) between the height position of the first upper surface of the upper leg portion and the height position of the top end surface of the upper leg portion can be large. Therefore, even when the fastener chain or the fastener stringer is twisted, and the fastener element receives a pressing force to be pressed toward a tape inside of the fastener tape, the sewing thread cannot easily climb over the top end surface of the upper leg portion (in other words, the top end surface of the upper leg portion cannot easily pass through the sewing thread). As a result, troubles such that the fastener element exits from the sewing thread and came off to a tape inside can less occur.

In the present invention, the upper leg portion has a first lower surface which is sloped toward the coupling head portion to be away from the fastener tape in a plan view of the fastener element, and a second lower surface which is sloped toward the coupling head portion to approach the fastener tape or to be parallel to the fastener tape. The upper leg portion of the fastener element has the element contacting portion which is formed to be able to contact with the fastener element of the coupling counterpart, and the element contacting portion is disposed in an area on which the first lower surface is disposed in the tape width direction.

Since the element contacting portion as mentioned above is provided on a part which the first lower surface of the upper leg portion is disposed of each fastener element, when the right and left fastener elements are coupled, a coupled amount of the coupled right and left fastener elements can be regulated in a predetermined degree. Thereby, when a plurality of right and left fastener elements in a coupled state are sewn to the right and left fastener tapes using a sewing machine, a gap in which a sewing needle can be inserted can be stably secured between the fastener elements adjacent in the length direction so that the sewing needle does not interfere the fastener elements. As a result, sewing processing to sew the fastener elements to the fastener tape can be smoothly and stably performed so that the vertical move of the sewing needle is not interfered by the fastener element on the coupling counterpart.

In the fastener chain of the present invention, in particular, the space portion formed between the upper leg portion and the lower leg portion of the fastener element has, in the tape width direction, a first space portion disposed on the connecting portion side of the bent portion, and a second space portion disposed on the coupling head portion side of the bent portion. In this case, the second space portion is provided with a larger height dimension than the first space portion. The element contacting portion of the upper leg portion is provided such that the lower surface of the element contacting portion is bulged gently in a convex surface shape toward the second space portion in the front view (back surface view) of the fastener element viewing the fastener element from the tape length direction. Since the element contacting portion is provided to bulge in a convex shape in an area of the second space portion in each fastener element, when the right and left fastener elements are coupled, the coupled amount of the fastener elements can be stably regulated in a predetermined degree.

In such a fastener chain of the present invention, a height dimension between a position of the top and surface and a position of the bent portion in the upper leg portion is 25% or smaller of the height dimension of the whole fastener element. Therefore, the step in the height direction between the first upper surface and the top end surface of the upper leg portion can be provided appropriately not to be too large, and the slide fastener can be finished such that the element rows have good outer appearance quality and good touch feeling.

In the present invention, the monofilament to form a plurality of fastener elements has a cross-sectional shape at the upper leg portion and the lower leg portion showing a flattened and substantially oval shape in which the width dimension of the monofilament is larger than the height dimension of the monofilament. Thereby, the fastener element can be easily formed so that the height dimension between the top end surface and the bent portion of the upper leg portion is 20% or larger of the height dimension of the whole fastener element. Such a fastener element can have increased coupling strength compared with a case that the cross-section of the upper leg portion and the lower leg portion is a circular shape, for example.

Further in the present invention, the maximum value of the height dimension of the second space portion is 50% or larger and 100% or smaller of the height dimension of the lower leg portion (in other words, the height dimension of the monofilament to form the fastener element). Thereby, a part of the fastener element on the coupling counterpart can be smoothly inserted into the second space portion, and the right and left fastener elements can be stably coupled. The fastener element on the coupling counterpart can also be contacted with the element contacting portion which is bulged in the second space portion of the fastener element.

Next, the slide fastener provided by the present invention is formed by attaching a slider to the right and left element rows formed on the fastener chain having the above-mentioned configuration. For such a slide fastener of the present invention, a plurality of the fastener elements are attached to the fastener tape without using the core string, thereby manufacturing cost can be reduced. Even when the fastener element receives a pressing force to be pushed toward a tape inside of the fastener tape, the fastener element can be prevented from exiting to the tape inside, and the function of the slide fastener can be stably maintained.

MODES FOR CARRYING OUT THE INVENTION

Hereinafter, a preferred Embodiment of the present invention will be described in detail with reference to the drawings. The present invention is not limited to the Embodiment described below, and various modifications can be made as long as they have substantially the same structure as the present invention and exhibit the same functional effects.

EMBODIMENT

Figure 1:
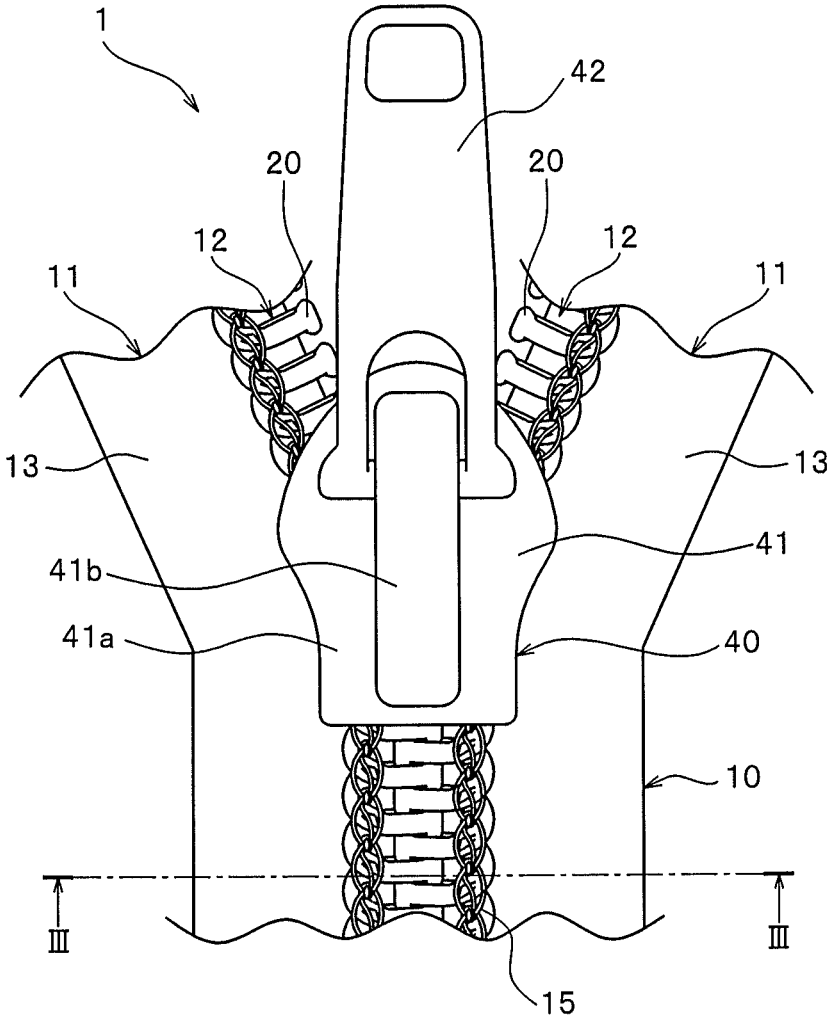
FIG. 1 is a plan view illustrating a slide fastener according to Embodiment of the present invention.
Figure 2:
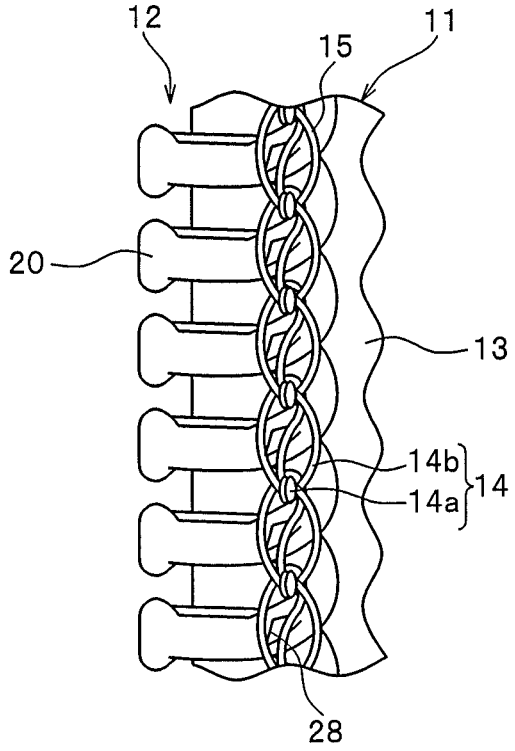
FIG. 2 is a plan view illustrating a main part of one of fastener stringers included in the slide fastener shown in FIG. 1.
Figure 3:
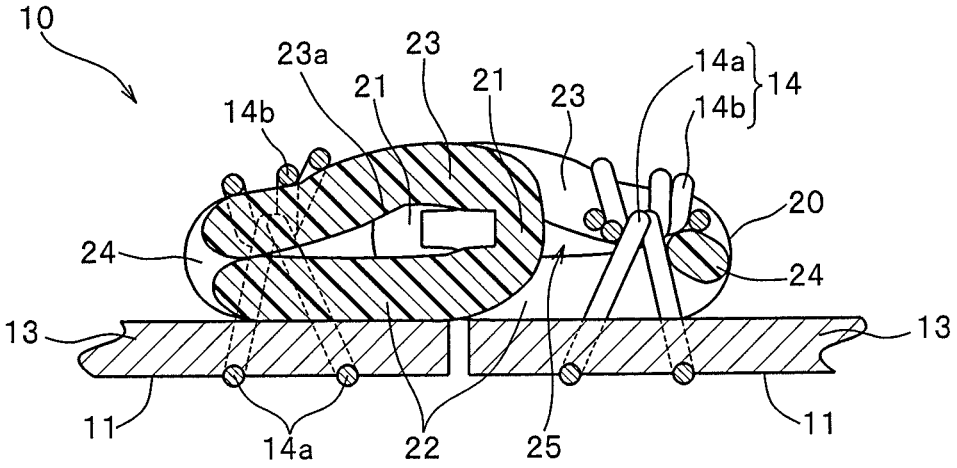
FIG. 3 is a cross-sectional view along the line III-III as shown in FIG. 1.
Figure 4:
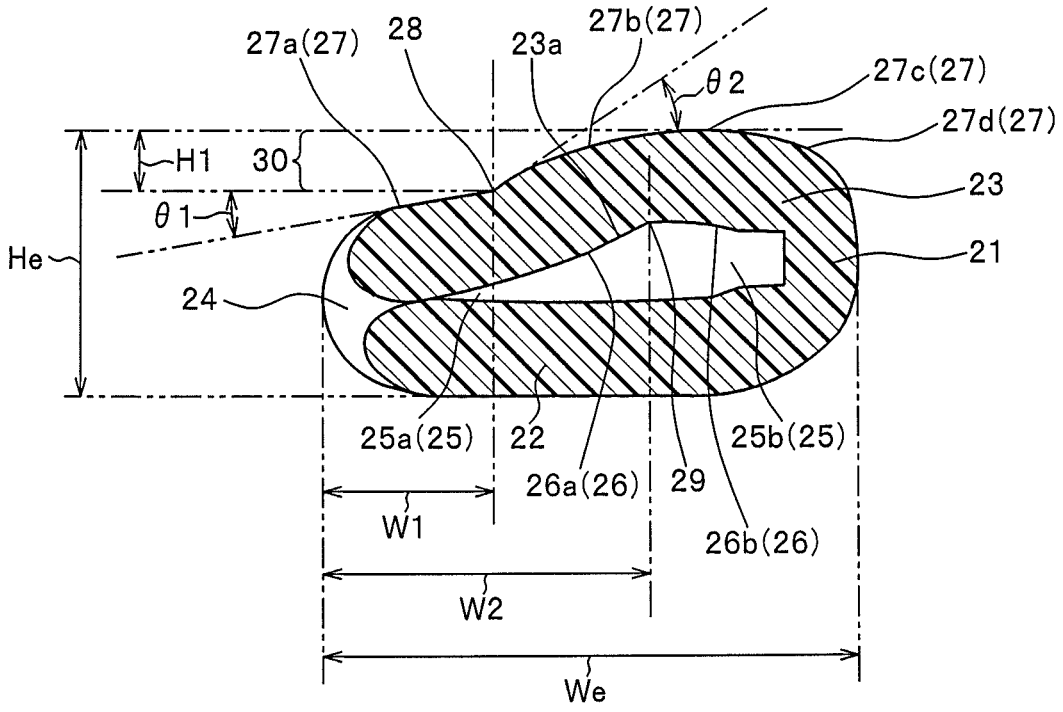
FIG. 4 is a cross-sectional view of the fastener element only.

FIG. 1 is a plan view illustrating a slide fastener according to Embodiment, and FIG. 2 is a plan view illustrating a main part of a fastener stringer on the right side. FIG. 3 is a cross-sectional view along the line III-III shown in FIG. 1, and FIG. 4 is a cross-sectional view of the fastener element only.

In the following explanation, a front and rear direction means a tape length direction of the fastener tape which is parallel to the sliding direction of the slider, and the direction that the slider slides to couple right and left element rows (closing direction) is defined as the front, and the direction to separate right and left element rows (separating direction) is the rear. A right and left direction means a tape width direction of the fastener tape, and is a direction perpendicular to the sliding direction of the slider as well as parallel to a top surface (upper surface) and a back surface (lower surface) of the fastener tape, for example.

An upper and lower direction means a direction perpendicular to the front and rear direction and to the right and left direction, and for example, it means a height direction of a fastener element perpendicular to the top surface (tape upper surface) and the back surface (tape lower surface) of the fastener tape. In the case of Embodiment, in particular, a direction on a side the fastener element is attached with respect to the fastener tape is an upper side, and a direction on the opposite side is a lower side.

A slide fastener 1 according to Embodiment is formed by attaching a slider 40 to element rows 12 of a fastener chain 10 having a right and left pair of fastener stringers 11 to be able to slide. In this case, the slider 40 has the substantially same configuration as a general slider used for a slide fastener having conventional coil-shaped fastener elements.

The slider 40 of Embodiment is briefly explained. The slider 40 has a slider body 41 and a tab 42 to be attached to the slider body 41. The slider body 41 has an upper blade 41*a*, a lower blade disposed to be apart from the upper blade 41*a*, a connecting column connecting a front end part of the upper blade 41*a* and a front end part of the lower blade, right and left upper flange portions extending from right and left side edge parts of the upper blade 41*a* toward the lower blade, and a tab attaching portion 41*b* provided on the upper blade 41*a*.

On a front end part of the slider body 41, right and left shoulder mouths are provided to interpose the connecting column therebetween, and a rear mouth is provided on a rear end part of the slider body 41. Between the upper blade 41*a* and the lower blade, an element guide pass in a substantially Y-shape and communicating the right and left shoulder mouths and the rear mouth is formed.

Each of right and left fastener stringers 11 of Embodiment has a fastener tape 13 and a plurality of fastener elements 20 in a continuous manner and sewn to a tape side edge part near the coupling counterpart side of the fastener tape 13 with a sewing thread 14, and is formed without using a core string which is set on a conventional general coil-shaped fastener element row.

A plurality of fastener elements 20 disposed on the fastener stringer 11 are formed by rolling a monofilament made of thermoplastic resin such as polyamide or polyester so that a cross-section (lateral cross-section) perpendicular to the length direction has a flattened and substantially oval shape, and thereafter, while molding the rolled monofilament in a coil shape, serially performing a predetermined press processing to form a coupling head portion 21 and a bent portion 28, as described later.

In this case, a lateral cross-sectional shape of the monofilament at the upper leg portion 23 and the lower leg portion 22, as described later, of the fastener element 20 is a substantially oval shape near a rounded rectangle in which the upper surface and the lower surface are formed in a substantially flat shape and a dimension in the height direction of the monofilament is shorter than the dimension in the width direction by the above-mentioned rolling processing. Thereby, in the slide fastener 1 of Embodiment, compared with the fastener element formed from the monofilament having the circular lateral cross-section, when a plurality of fastener elements 20 are arranged in the same constant intervals (forming pitches), the interval between the fastener elements 20 adjacent in the length direction can be made small.

Therefore, the coupling head portion 21 on the coupling counterpart can be engaged firmly between the fastener elements 20 adjacent in the length direction. As a result, the coupling strength of the right and left element rows can be increased. Particularly when a part of the element rows 12 is partially bent strongly in the tape top and back direction while the right and left element rows 12 are coupled, the possibility of so-called chain breaking such as discoupling of the fastener elements 20 can be reduced.

Each fastener element 20 of Embodiment has a coupling head portion 21 disposed outside a tape side edge of the fastener tape 13, a lower leg portion 22 extending from a lower end part of the coupling head portion 21 in the tape width direction, an upper leg portion 23 extending in the tape width direction from an upper end part of the coupling head portion 21 to be apart from the lower leg portion 22, and a connecting portion 24 connecting the upper leg portion 23 and a lower leg portion 22 of another fastener element 20 (fastener element adjacent in front in the case of Embodiment) adjacent in one of the length direction.

Each fastener element 20 is, in a plan view of the fastener element 20 viewing from the tape length direction, or a cross-sectional view (see FIG. 4) of the fastener element 20 in a direction perpendicular to the tape length direction, fixed with a sewn portion (stitches) 15 of a sewing thread 14 in a state that the upper leg portion 23 and the lower leg portion 22 directly face to each other via the space portion 25 formed to be thin and long in the width direction, and no inclusion such as a core string is disposed between the upper leg portion 23 and the lower leg portion 22. In Embodiment, in particular, the upper leg portion 23 and the lower leg portion 22 directly face to each other not only in a partial region in the tape width direction, but also in a whole region of the tape width direction, via the space portion 25 without inclusion or in a contacted state.

In this case, the sewn portion 15 for fixing the fastener element 20 is formed with a multi-thread chain stitching using two sewing needles, and the sewing thread 14 for forming the sewn portion 15 has two needle threads 14*a* to pierce the fastener tape 13 and a looper thread 14*b* to contact the upper surface of the upper leg portion 23 (particularly a first upper surface 27*a*, described later, of the upper leg portion 23), to press the upper leg portion 23 toward the fastener tape 13 and to perform looping with the needle thread 14*a*. The fastener element 20 can be firmly fixed to the fastener tape 13 without a core string by sewing the fastener element 20 with the sewn portion 15 including the two needle threads 14*a*.

The coupling head portion 21 of the fastener element 20 is formed to extend in the upper and lower direction. In the middle part in the height direction of the coupling head portion 21, front and rear bulged portions bulged in the front and rear direction are provided. The bulged portion of the coupling head portion 21 is formed to be able to be inserted into a second space portion 25*b*, described later, of the fastener element 20 of the coupling counterpart, and to be able to contact with an element contacting portion 23*a*, described later, of the coupling counterpart fastener element 20.

The lower leg portion 22 is extended from a lower end part of the coupling head portion 21 along a right and left direction and is disposed to contact with the fastener tape 13. An end part of the lower leg portion 22 on a side close to the coupling counterpart is connected to the lower end part of the coupling head portion 21, and the other end part of the lower leg portion 22 on a side apart from the coupling counterpart is connected to the connecting portion 24 which is jointed with the upper leg portion 23 of a fastener element 22 adjacent in the rear direction. The lower leg portion 22 is formed in a linear form along the tape width direction or a substantially linear form to curve so that the middle part in the tape width direction is slightly declined.

The upper leg portion 23 has, in a front view or a cross-sectional view of the fastener element (see FIG. 4), a lower surface 26 facing to the lower leg portion 22, and an upper surface 27 disposed on an opposite side of the lower surface 26 and a side to be exposed outside. The lower surface 26 of the upper leg portion 23 has a first lower surface 26*a* which is sloped to be apart from the tape upper surface of the fastener tape 13 toward the coupling head portion 21, and a second lower surface 26*b* which is sloped to approach the tape upper surface of the fastener tape 13 toward the coupling head portion 21. Between the first lower surface 26*a* and the second lower surface 26*b*, a boundary portion 29 in a bent shape at which a slope angle is changed by 5° or larger (preferably 10° or larger) is disposed. The second lower surface 26*b* of the upper leg portion 23 may be disposed parallel to the tape upper surface of the fastener tape 13 partially.

The upper surface 27 of the upper leg portion 23 has a first upper surface (connecting-side upper surface) 27*a* continuously disposed from the connecting portion 24, a second upper surface (intermediate slope upper surface) 27*b* which is extended and sloped upward from the first upper surface 27*a* via the bent portion 28 toward the coupling head portion 21, a third upper surface (top end surface) 27*c* disposed farthest away from the fastener tape 13, and a fourth upper surface (head portion-side upper surface) 27*d* which is sloped downward from the third upper surface 27*c* toward the coupling head portion 21.

In this case, in the plan view or the cross-sectional view of the fastener element, at least the second upper surface 27*b*, the third upper surface 27*c* and the fourth upper surface 27*d* of the upper leg portion 23, and a part of the lower surface 26 corresponding to the second upper surface 27*b* through the fourth upper surface 27*d* of the upper leg portion 23 (i.e. the lower surface of the same area in the tape width direction corresponding to the second upper surface 27*b* through the fourth upper surface 27*d*) are disposed in a non-parallel relation which are not parallel to each other at each corresponding part. The non-parallel relation here means a relation except that, when the upper surface and the lower surface of the upper leg portion 23 are in a curved surface shape, directions of the curved surfaces (convex-shaped direction or concave-shaped direction toward the above, for example) are the same and at the same time, directions of the tangent line are the same.

In Embodiment, the bent portion 28 as a boundary between the first upper surface 27*a* and the second upper surface 27*b* of the upper leg portion 23, and the boundary portion 29 between the first lower surface 26*a* and the second lower surface 26*b* of the upper leg portion 23 are provided at different positions in the tape width direction from each other, and the boundary portion 29 of the lower surface 26 is disposed at a position closer to the coupling head portion 21 in the tape width direction (position shifted on the coupling head portion 21 side), with respect to the bent portion 28 of the upper surface 27.

The first upper surface 27*a* of the upper leg portion 23 is disposed smoothly and continuously without forming a step with respect to the upper surface of the connecting portion 24, and in the plan view or the cross-sectional view of the fastener element, it is moderately sloped upward toward the coupling head portion 21 so as to be gradually separated from the fastener tape 13 to the bent portion 28. In Embodiment, the first upper surface 27*a* of the upper leg portion 23 is sloped at a substantially constant angle.

In this case, a slope angle θ1 of the first upper surface 27*a* to the tape upper surface of the fastener tape 13 is larger than 0° and 30° or smaller, and preferably 5° or larger and 20° or smaller. The slope angle θ1 here means an angle between an imaginary flat surface formed to be extended from the bent portion 28 toward the connecting portion 24 side in a direction parallel to the tape upper surface of the fastener tape 13, and the first upper surface 27*a*. By making the slope angle θ1 of the first upper surface 27*a* larger than 0°, the space portion 25 (particularly, a second space portion 25*b*, described later) can be secured in an appropriate size between the upper leg portion 23 and the lower leg portion 22, and a part of a coupling head portion 21 on the coupling counterpart can be smoothly inserted in the space portion 25.

By making the slope angle θ1 of the first upper surface 27*a* at 30° or smaller, the sewing thread 14 (looper thread 14*b*) of the sewn portion 15 can be contacted and stably placed on the first upper surface 27*a*. Further, a height dimension H1 of a clearance 30 provided between a position of the third upper surface (top end surface) 27*c* and a position of the bent portion 28 can be easily secured in a large degree, as described later.

The second upper surface 27*b* of the upper leg portion 23 is, in the plan view or the cross-sectional view of the fastener element, formed to have a larger slope angle than the first upper surface 27*a* of the upper leg portion 23 via the bent portion 28, and is formed to be slightly curved upward in a convex shape while the slope angle is decreased toward the coupling head portion 21.

In this case, the bent portion 28 of the upper leg portion 23 is a part that the slope angle of the upper surface of the upper leg portion 23 is locally changed. In Embodiment, in the plan view of the fastener element 20 from the above, it is formed as a short linear mark or the like which is slightly oblique to the tape length direction, for example. Such a bent portion 28 is formed due to the press processing for providing a step in the height direction between the first upper surface 27*a* and the top end surface 27*c* of the upper leg portion 23 in the molding process of molding a linear-shaped monofilament to the coil-shaped fastener element 20, and in some cases, it can be seen as a processing trace (molding trace) when the fastener element 20 is viewed to be enlarged.

As shown in FIG. 4, the bent portion 28 of Embodiment is formed such that a slope angle θ2 at a part close to the bent portion 28 on the second upper surface 27*b* is larger than the above-mentioned slope angle θ1 of the first upper surface 27*a* (particularly, the slope angle at a part close to the bent portion 28 on the first upper surface 27*a*). The slope angle θ2 here means an angle between an imaginary flat surface formed to be extended in a direction parallel to the tape upper surface of the fastener tape 13 from the bent portion 28 toward the coupling head portion 21 side and a part close to the bent portion 28 in the second upper surface 27*b*. The part close to the bent portion 28 in the second upper surface 27*b* means a surface of a part to be directly extended from the bent portion 28 of the second upper surface 27*b*. The slope angle θ2 in a case that the close part is formed to be a curved surface is an angle that the tangent line of the curved surface is sloped with respect to the tape upper surface of the fastener tape 13.

In the case of Embodiment, the slope angle of the above-mentioned part of the second upper surface 27*b* to the tape upper surface of the fastener tape 13 is 5° or larger and 80° or smaller, and preferably 15° or larger and 60° or smaller. Further, a difference of the slope angles in the first upper surface 27*a* and in the second upper surface 27*b* disposed on the right and left of the bent portion 28 is 5° or larger and 70° or smaller, and preferably 10° or larger and 60° or smaller.

Since the slope angle θ2 of the second upper surface 27*b* is set as above with respect to the tape upper surface of the fastener tape 13 and the first upper surface 27*a* of the upper leg portion 23, and when the slide fastener 1 is twisted and the fastener elements 20 receive a pressing force to be pushed toward the tape inside of the fastener tape 13, for example, it can be less occurred that the sewing thread 14 slips on the second upper surface 27*b* of the upper leg portion 23 and climbs over the third upper surface (top end surface) 27*c*. Further, the height dimension He of the entire fastener element 20 can be controlled in an appropriate size, thereby outer appearance quality and touch feeling of the slide fastener 1 can be improved.

The third upper surface (top end surface) 27*c* of the upper leg portion 23 is disposed between the second upper surface 27*b* which is sloped upward to the coupling head portion 21 and the fourth upper surface 27*d* which is sloped downward to the coupling head portion 21, and is formed to be a flat surface parallel to the tape upper surface of the fastener tape 13 or a continuous curved surface in which the tangent line is parallel to the tape upper surface of the fastener tape 13 in the plan view or the cross-sectional view of the fastener element.

In the fastener element 20 of Embodiment, a first width dimension W1 which is a dimension in the tape width direction from the bent portion 28 to an element end edge on the tape inside of the fastener tape 13 is 20% or larger and 50% or smaller, and preferably 25% or larger and 40% or smaller of a width dimension We of the entire fastener element 20, as shown in FIG. 4. The width dimension We of the entire fastener element 20 means a dimension in the tape width direction from the element end edge disposed on the tape-innermost in the connecting portion 24 of the fastener element 20 to the element end edge disposed on the tape-outermost in the coupling head portion 21.

Since the first width dimension W1 is 20% or larger of the width dimension We of the entire fastener element 20, the width dimension of the first upper surface 27*a* can be appropriately secured, and the sewing thread 14 can be stably contacted with the first upper surface 27*a*, thereby the fastener element 20 can be fixed with the sewing thread 14 firmly.

On the other hand, since the first width dimension W1 is 50% or smaller of the width dimension We of the entire fastener element 20, an element contacting portion 23*a*, described later, can be formed stably on the upper leg portion 23. Further, the sewing thread 14 can be arranged in an area on the connecting portion 24 side of the center position in the tape width direction of the fastener element 20, and preferably arranged in an area that the width dimension of the fastener element 20 from the element end edge position on the tape inside is 40% or smaller of the entire width dimension We of the fastener element 20, thereby the fastener element 20 can be fixed.

Thus, an influence of the sewn portion 15 to a move of the coupling head portion 21 of the fastener element 20 can be reduced, and the coupling head portion 21 can be allowed easily to move in the tape length direction. As a result, when the slider 40 is slid in the closing direction of the element rows 12, the right and left fastener elements 20 can be easily coupled within the element guide pass of the slider 40, which improves slidability of the slider 40.

In Embodiment, the height dimension H1 of the clearance 30 provided from the height position (position in the height direction) of the top end surface 27*c* of the fastener element 20 to the height position of the bent portion 28 is 20% or larger and 25% or smaller of the height dimension of the entire fastener element 20, as shown in FIG. 4. The height dimension He of the entire fastener element 20 here means a dimension in the tape top and back direction from a height position of the lower surface of the lower leg portion 22 of the fastener element 20 (or a height dimension of the tape upper surface of the fastener tape 13) to the third upper surface (top end surface) 27*c* of the upper leg portion 23.

Since the height dimension H1 of the clearance 30 as mentioned above is 20% or larger of the height dimension He of the entire fastener element 20, even when the fastener element 20 receives a pressing force so as to be pushed toward the tape-inside of the fastener tape 13, the sewing thread 14 can keep holding the upper leg portion 23 firmly and stably. Thereby, move of the fastener element 20 in the tape width direction is restricted, and it can be less likely to occur that the sewing thread 14 relatively climbs over the top end surface 27*c* of the upper leg portion 23 (the top end surface 27*c* of the upper leg portion 23 passes under an inside the sewing thread 14).

In a case of a conventional coil-shaped fastener element having a core string as in Patent Document 1, it was difficult to make the height dimension of the clearance from the height position of the top end surface of the fastener element to the height position of the bent portion to be 20% or larger of the height dimension of the entire fastener element. In Embodiment, however, the conventional core string is not arranged between the upper leg portion 23 and the lower leg portion 22, and the monofilament to form the fastener element 20 has a substantially oval-shaped lateral cross-sectional shape in which the height dimension is short as mentioned above. Therefore, it becomes possible to easily secure the height dimension H1 of the above-mentioned clearance 30 to be in a size of 20% or larger of the height dimension He of the entire fastener element 20.

On the other hand, since the height dimension H1 of the clearance 30 is 25% or smaller of the height dimension He of the entire fastener element 20, thereby a difference between the height position of the first upper surface 27*a* of the upper leg portion 23 and the height position of the third upper surface 27*c* is prevented from being too large, and the element row 12 of the slide fastener 1 can be formed to have good outer appearance quality and good touch feeling.

The space portion 25 formed between the upper leg portion 23 and the lower leg portion 22 in the plan view or the cross-sectional view of the fastener element (FIG. 4) 20 has, in the tape width direction, a first space portion 25*a* disposed on the connecting portion 24 side of the position of the bent portion 28 in the upper leg portion 23, and a second space portion 25*b* disposed on the coupling head portion 21 side of the position of the bent portion 28. The second space portion 25*b* is formed to have a larger height dimension than the maximum value of the height dimension of the first space portion 25*a*. That is, the second space portion 25*b* of the fastener element 20 is formed so that the minimum value of the height dimension is larger than the maximum value of the height dimension of the first space portion 25*a*. The height dimension of the first space portion 25*a* and the height dimension of the second space portion 25*b* here mean dimensions from the upper surface of the lower leg portion 22 to the lower surface 26 of the upper leg portion 23.

The maximum value of the height dimension of the second space portion 25*b* is 50% or larger and 100% or smaller, and preferably 60% or larger and 95% or smaller of the height dimension from the lower surface to the upper surface of the lower leg portion 22 (in other words, the height dimension of the monofilament to form the fastener element 20). In the case of Embodiment, regarding the tape width direction, the height dimension of the second space portion 25*b* is the largest at the position of the boundary portion 29 disposed between the first lower surface 26*a* and the second lower surface 26*b* of the upper leg portion 23.

As mentioned above, since the maximum value of the height dimension of the second space portion 25*b* is 50% or larger of the height dimension of the lower leg portion 22, a part of the coupling head portion 21 of the coupling counterpart can be smoothly inserted into the second space portion 25*b*, and the right and left fastener elements 20 can be stably coupled. Further, since the maximum value of the height dimension of the second space portion 25*b* is 100% or smaller of the height dimension of the lower leg portion 22, the bulged portion disposed on the coupling head portion 21 of the coupling counterpart can be stably contacted with an element contacting portion 23*a*, described later, of the upper leg portion 23. In addition, the height dimension He of the entire fastener element 20 can be smaller than that of the conventional coil-shaped fastener element having the core string, for example, improvement in outer appearance quality and touch feeling of the slide fastener 1 can be attempted.

The upper leg portion 23 of Embodiment has an element contacting portion 23*a* formed to moderately bulge in a convex surface shape toward the second space portion 25*b* in the plan view of the fastener element 20. In this case, the element contacting portion 23*a* is, regarding the tape width direction, provided on the second space portion 25*b*-side in an area in which the above-mentioned first lower surface 26*a* of the upper leg portion 23 is disposed in the plan view of the fastener element 20. That is, the element contacting portion 23*a* is, regarding the tape width direction, provided between the bent portion 28 provided on the upper surface of the upper leg portion 23 and the boundary portion 29 provided on the lower surface of the upper leg portion 23. The element contacting portion 23*a* can contact the coupling head portion 21 (particularly, the bulged portion of the coupling head portion 21) of the coupling counterpart when the right and left fastener elements 20 are coupled. As long as the element contacting portion 23*a* can contact with the coupling head portion 21 of the coupling counterpart, it may also be formed such that the lower surface of the element contacting portion 23*a* is not a curved surface slightly curved in a convex shape as in Embodiment, but a flat surface sloped at a constant angle in the plan view of the fastener element 20.

Figure 5:
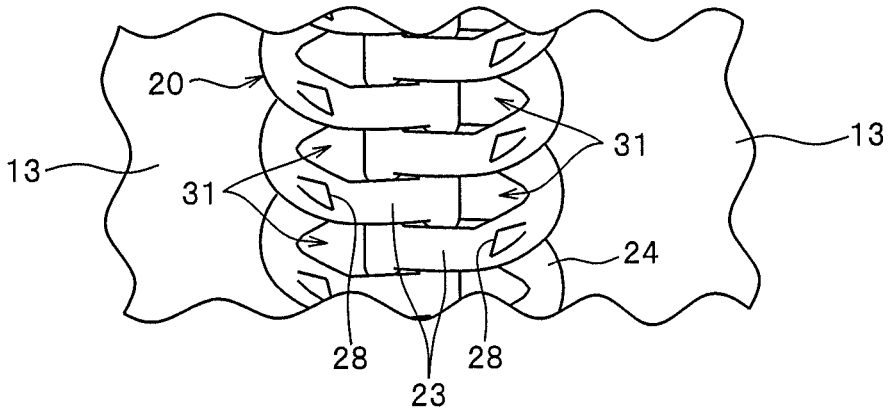
FIG. 5 is a plan view illustrating a state that right and left fastener elements are coupled before sewn to the fastener tapes.
Figure 6:
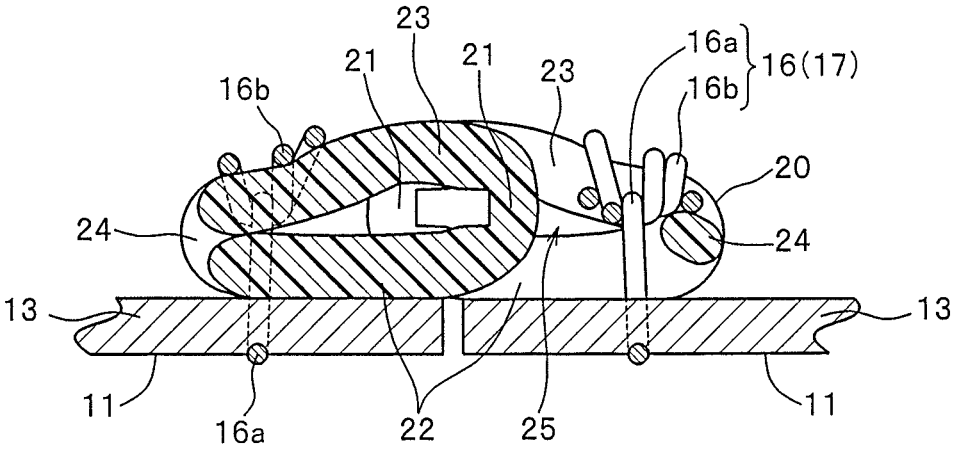
FIG. 6 is a cross-sectional view of slide fastener according to a modification example of the present invention.
Figure 7:
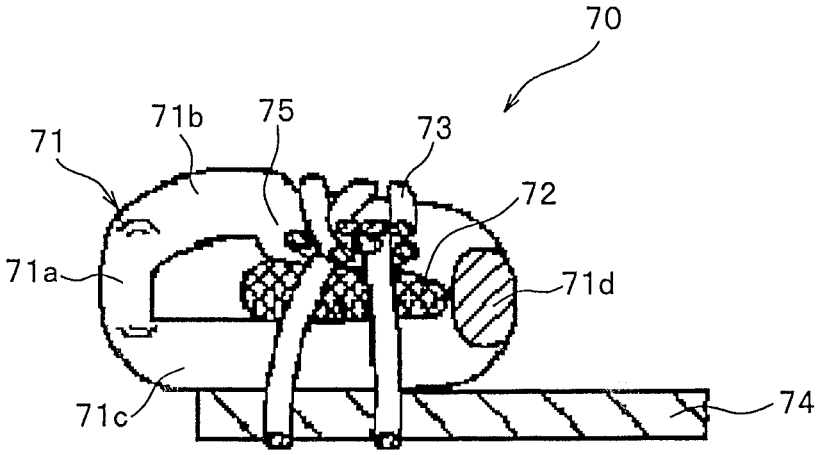
FIG. 7 is a cross-sectional view illustrating a conventional fastener stringer.

Since each fastener element 20 has such an element contacting portion 23*a*, when the right and left fastener elements 20 before sewn to the fastener tape 13 are coupled, for example, the coupled amount (depth of coupling) in the width direction of the coupled right and left fastener elements 20 can be controlled by the contact of the element contacting portion 23*a* of each fastener element 20 with the coupling head portion 21 of the coupling counterpart. As a result, in each part between the fastener elements 20 adjacent in the length direction, a gap 31 penetrating in the height direction can be provided between the connecting portion 24 of the fastener element 20 and the coupling head portion 21 of the coupling counterpart, as schematically shown in FIG. 5.

Therefore, when a plurality of right and left fastener elements 20 in a coupled state are sewn to the right and left fastener tapes 13 using a sewing machine, the sewing processing can be performed by inserting a sewing needle through the gap 31. Therefore, the sewing processing can be smoothly and stably performed so that vertical move of the sewing needle is not interrupted by the fastener element 20 of the coupling counterpart.

In this case, the second width dimension W2 which is a dimension in the width direction from the boundary portion 29 provided on the lower surface of the upper leg portion 23 to the element end edge on the tape inner side of the fastener element 20 is 50% or larger and 70% or smaller of the width dimension We of the entire fastener element 20. Since the second width dimension W2 is 50% or larger of the width dimension We of the entire fastener element 20, the above-mentioned element contacting portion 23*a* can be arranged at an appropriate position in the tape width direction, and thus when the right and left fastener elements 20 are coupled, the above-mentioned gap 31 can be stably provided.

On the other hand, since the second width dimension W2 is 70% or smaller of the width dimension We of the entire fastener element 20, a size of the second space portion 25*b* can be appropriately secured. Therefore, when the slider 40 is slid in the closing direction of the slide fastener 1 to couple the right and left element rows 12, a part of the coupling head portion 21 of the coupling counterpart can be smoothly inserted into the second space portion 25*b* of each fastener element 20, and the right and left fastener elements 20 can be stably coupled, which enables good slidability of the slider 40.

In the slide fastener 1 of Embodiment in which the fastener element 20 having the above-mentioned form is fixed to the fastener tape 13 with the sewn portion 15, the core string disposed in the slide fastener in Patent Document 1 is not disposed, thereby cost reduction of the slide fastener 1 can be achieved.

In the slide fastener 1 of Embodiment, the above-mentioned clearance 30 is provided between the third upper surface (top end surface) 27*c* and the bent portion 28, and a difference between the height position of the first upper surface 27*a* and the third upper surface 27*c* of the upper leg portion 23 is secured to a large degree. Further, the sewing thread 14 is contacted with the first upper surface 27*a* of the upper leg portion 23, and fixes the upper leg portion 23 to the fastener tape 13 firmly.

Therefore, when the slide fastener 1 is twisted or the like, and the fastener element 20 receives a pressing force so as to be pushed toward a tape inside of the fastener tape 13, for example, the third upper surface 27*c* of the upper leg portion 23 can be prevented from passing through the sewing thread 14 (looper thread 14*b*), thereby the fastener element 20 of Embodiment can be prevented from removing from the sewing thread 14 and protruding to the tape inside. Thus, the slide fastener 1 of Embodiment has a structure that the fastener element 20 is less likely to be removed from the sewn portion 15 despite it has no core string, thereby it has a stable quality to be able to endure long-time use.

In the above-mentioned slide fastener 1 of Embodiment, the fastener element 20 is fixed to the fastener tape 13 with the sewn portion 15 which includes two needle threads 14*a* and one looper thread 14*b* and is formed by multi-thread chain stitching. In the present invention, however, the form of the sewn portion for fixing the fastener element is not particularly limited as long as a part of the sewing thread in the sewn portion is contacted with the first upper surface of the fastener element.

In the present invention, it is also possible that the fastener element 20 is fixed to the fastener tape 13 with a sewn portion 17 which uses a sewing thread 16 including one needle thread 16*a* and one looper thread 16*b* and is formed by multi-thread chain stitching. The fastener element 20 can be stably fixed to the fastener tape 13 also by employing such a sewn portion 17 according to the modified example. Further, the sewn portion 17 of the modified example is formed to have the fewer number of the needle threads 16*a* compared with the case of the sewn portion 15 of Embodiment as mentioned above. Therefore, further cost reduction can be realized.

REFERENCE SIGNS

1: Slide fastener
10: Fastener chain
11: Fastener stringer
12: Element row
13: Fastener tape
14: Sewing thread
14*a*: Needle thread
14*b*: Looper thread
15: Sewn portion
16: Sewing thread
16*a*: Needle thread
16*b*: Looper thread
17: Sewn portion
20: Fastener element
21: Coupling head portion
22: Lower leg portion
23: Upper leg portion
23*a*: Element contacting portion
24: Connecting portion
25: Space portion
25*a*: First space portion
25*b*: Second space portion
26: Lower surface
26*a*: First lower surface
26*b*: Second lower surface
27: Upper surface
27*a*: First upper surface (connecting-side upper surface)
27*b*: Second upper surface (intermediate slope upper surface)
27*c*: Third upper surface (top end surface)
27*d*: Fourth upper surface (head portion-side upper surface)
28: Bent portion
29: Boundary portion
30: Clearance
31: Gap
40: Slider
41: Slider body
41*a*: Upper blade
41*b*: Tab attaching portion
42: Tab
H1: Height dimension of clearance
He: Height dimension of entire fastener element
W1: First width dimension of fastener element
W2: Second width dimension of fastener element
We: Width dimension of entire fastener element
θ1: Slope angle of first upper surface
θ2: Slope angle of second upper surface

The invention claimed is:

1. A fastener chain comprising a pair of fastener stringers in which a plurality of fastener elements continuing in a coil shape are sewn to right and left fastener tapes with a sewing thread; the fastener element comprising a coupling head portion, a lower leg portion extending from one end part of the coupling head portion in a tape width direction and contacting with the fastener tape, an upper leg portion extending in the tape width direction from the other end part of the coupling head portion to be apart from the lower leg portion, and a connecting portion connecting the upper leg portion and the lower leg portion of another fastener element adjacent in a length direction, wherein:

the fastener element is sewn to the fastener tape with a sewing thread different from threads forming the fastener tape, the upper leg portion and the lower leg portion face each other via a space portion at least in a portion fixed by the sewing thread of the fastener element, the upper leg portion comprises a first upper surface continuing from the connecting portion, and a second upper surface extending and sloping upward from the first upper surface via a bent portion toward the coupling head portion, the sewing thread pierces the fastener tape and is disposed to contact with the first upper surface of the upper leg portion, a height dimension between a position of a top end surface of the upper leg portion disposed farthest from the fastener tape and a position of the bent portion is 20% or larger of a height dimension of the entire fastener element, the upper leg portion comprises a first lower surface which is sloped to be apart from the fastener tape toward the coupling head portion, and a second lower surface which is sloped to approach the fastener tape toward the coupling head portion or parallel to the fastener tape, and the upper leg portion comprises an element contacting portion with which the fastener element of a coupling counterpart is contacted.

2. The fastener chain according to claim 1, wherein the space portion comprises a first space portion disposed on a connecting portion side of the bent portion, and a second space portion disposed on a coupling head portion side of the bent portion and has a larger height dimension than the first space portion, the element contacting portion is disposed to bulge in a convex surface shape toward the second space portion in a plan view of the fastener element.

3. The fastener chain according to claim 1, wherein a height dimension between a position of the top end surface and a position of the bent portion in the upper leg portion is 25% or smaller of the height dimension of the entire fastener element.

4. The fastener chain according to claim 1, wherein a monofilament forming a plurality of the fastener elements has a cross-sectional shape at the upper leg portion and the lower leg portion showing a flattened and substantially oval shape that a width dimension of the monofilament is larger than a height dimension of the monofilament.

5. The fastener chain according to claim 1, wherein the maximum value of the height dimension of a second space portion is 50% or larger and 100% or smaller of the height dimension of the lower leg portion.

6. A slide fastener wherein, the slide fastener is formed by attaching a slider to right and left element rows of the fastener chain according to claim 1.

* * * * *